US006019598A

United States Patent [19]

Kinsey et al.

[11] Patent Number: 6,019,598

[45] Date of Patent: Feb. 1, 2000

[54] AIR RECUPERATOR FOR COMBUSTION AIR BURNERS

[75] Inventors: Jerry L. Kinsey; Mike L. White; Tim C. Hebaue, all of Ft. Wayne, Ind.

[73] Assignee: Dana Corporation, Toledo, Ohio

[21] Appl. No.: 09/110,152

[22] Filed: Jul. 6, 1998

[51] Int. Cl.[7] ..... F27B 5/14

[52] U.S. Cl. ..... 432/209; 432/175; 126/91 A; 165/142

[58] Field of Search ..... 432/209, 175, 432/72, 179, 180, 181; 110/147, 160, 162; 126/91 A

[56] References Cited

U.S. PATENT DOCUMENTS

| | | |
|---|---|---|
| 2,188,133 | 1/1940 | Hepburn . |
| 3,079,910 | 3/1963 | Bloom et al. . |
| 4,140,482 | 2/1979 | Simon . |
| 4,310,303 | 1/1982 | Collier . |
| 4,467,779 | 8/1984 | Kreinin et al. . |
| 4,479,535 | 10/1984 | Exhigo et al. . |
| 4,496,314 | 1/1985 | Clarke . |
| 4,524,752 | 6/1985 | Clarke . |
| 4,856,492 | 8/1989 | Kawamoto . |
| 4,870,947 | 10/1989 | Kawamoto . |

*Primary Examiner*—Mark Paschall
*Assistant Examiner*—Jiping Lu
*Attorney, Agent, or Firm*—Liniak, Berenato, Longacre & White

[57] ABSTRACT

A recuperator of simple design constructed from a hollow tube. A penetrating tube is formed of a hollow tube, preferably of stainless steel, closed at one end and open at the other end. The open end is cut and welded, or otherwise secured, to a perpendicular hollow tube which introduces and expels ambient air. A divider wall is disposed within the penetrating tube to force introduced ambient air along the length of the penetrating tube before exiting the recuperator. This arrangement exposes the ambient air to the heated surface of the penetrating tube along its entire flow path, substantially twice the length of the penetrating tube. A spiralled strip of 14 gage stainless steel may be disposed within the penetrating tube to enhance heat exchange between the penetrating tube and ambient air flowing there within.

9 Claims, 1 Drawing Sheet

AIR RECUPERATOR FOR COMBUSTION AIR BURNERS

BACKGROUND OF THE INVENTION

1. Field of the Invention

The present invention relates to a recuperator for combustion air burners and particularly to a simple design for such a recuperator.

2. Description of the Prior Art

Air recuperators which heat incoming furnace combustion air from ambient temperature to a much higher temperature are well known in the prior art. These recuperators heat ambient air to temperatures between 700–1000 degrees Fahrenheit by cycling the air through the exhaust gases of the combustion system. The heated air is then used as combustion air to increase combustion efficiency. Recuperators disposed within the furnace are exposed to temperatures exceeding 1700 degrees Fahrenheit. Examples of various recuperator designs are disclosed in U.S. Pat. No. 4,856,4923 to Kawamoto; 4,524,752 and 4,496,314 to Clarke; 4,479,535 to Echogo, et al.; 4,467,779 to Kreinin, et al.; 4,310,303 to Collier; and 2,188,133 to Hepburen; and are each incorporated herein by reference.

However, each of these recuperator designs suffer from the drawback that they are complicated to construct, are very expensive, and have a relatively short life when exposed to the harsh conditions of the furnace. Conventional recuperators cost in excess of 750.00 dollars and have a life span as short as three months.

It is an object of the present invention to provide a recuperator of simple design which is easy to construct, relatively inexpensive, and has a prolonged life span.

SUMMARY OF THE INVENTION

The present invention comprises a simple design constructed from a hollow tube. A penetrating tube is formed of a hollow tube, preferably of stainless steel, closed at one end and open at the other end. The open end is cut and welded, or otherwise secured, to a perpendicular hollow tube which introduces and expels ambient air. A divider wall is disposed within the hollow tubes to force introduced ambient air along the length of the penetrating tube before exiting the recuperator. This arrangement exposes the ambient air to the heated surface of the penetrating tube along its entire flow path there within. A spiralled strip of 14 gage stainless steel may be disposed within the penetrating tube to enhance heat exchange between the penetrating tube and ambient air flowing there within.

The present design minimizes sharp corners and weld joints thereby minimizing the possibility of cracking. This design also reduces air restriction within the tube to lower penetrating tube pressure to minimize catastrophic leaks. Furthermore, the recuperator of the present invention costs less than 150 dollars to manufacture and has been shown to have a service life span exceeding six months without significant wear. These and other advantages of the present invention will become readily apparent from the drawings and detailed description articulated below.

DETAILED DESCRIPTION OF THE PREFERRED EMBODIMENT

Figure 1:
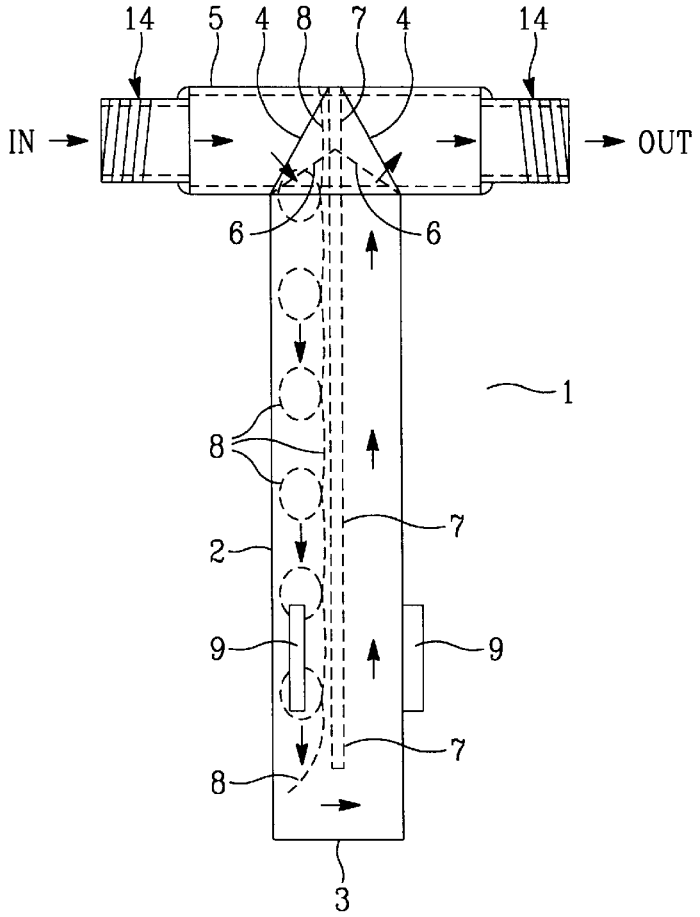
FIG. 1 is a top plan view of a recuperator according to the present invention.

FIG. 1 is a top plan view of the recuperator 1 according to the present invention. In the preferred embodiment a penetrating tube 2 is formed from a 1.5 inch inner diameter stainless steel tube having a length of 28 inches. The penetrating tube is closed at one end 3 and cut at the other end 4 for welding, or otherwise attached, to a second tube 5. The second tube 5, also formed of the 1.5 inch inner diameter stainless steel tube is cut or notched along lines 6 to expose the interior. The cut end 4 of the penetrating tube 2 is disposed over the notched portion 6 of the second tube 5 and secured thereto. Preferably the penetrating tube 2 and second tube 5 are welded to one another.

The opposite ends 14 of the second tube 5 are threaded for conventional attachment to an ambient air introduction duct to import ambient air to the recuperator and at the opposite end connecting to a channel leading to the combustion air duct of the furnace. In the preferred embodiment, the second tube 5 extends a total length of eight inches. The second tube 5 is preferably formed of a four inch 1.5 inner diameter stainless tube with two connection portions 14 each extending an additional two inches. These connection portions 14 are preferably formed on 1.25 inch inner diameter stainless steel tube fixedly secured to the second tube 5.

A divider wall 7 is disposed within the penetrating tube 2 extending from the terminal portion of the cut end. Ambient air introduced into the second tube 5 impinges the divider wall 7 and is forced along the length of the penetrating tube 2 to the closed end and is then forced to return along the length of the penetrating tube 2 before exiting the second tube 5. This simple arrangement exposes the ambient air to the surface of the heated penetrating tube 2 along the entire flow path, which is substantially twice the length of the penetrating tube 2.

A spiralled coil 8 of 14 gage stainless steel, preferably ⅝ inch extending a length of 27 inches, may be disposed in one or both sides of the penetrating tube 2 to enhance the heat transfer from the penetrating tube 2 to the ambient air. FIG. 1 shows only one spiralled coil, however, another coil may be employed on the opposite side of the divider wall 7.

Spacer blocks 9 are secured to the external side of tube 2 to position the penetrating tube within radiant tube 10 of the furnace. Preferably three spacer blocks are employed spaced apart equally about the penetrating tube 2.

Figure 2:
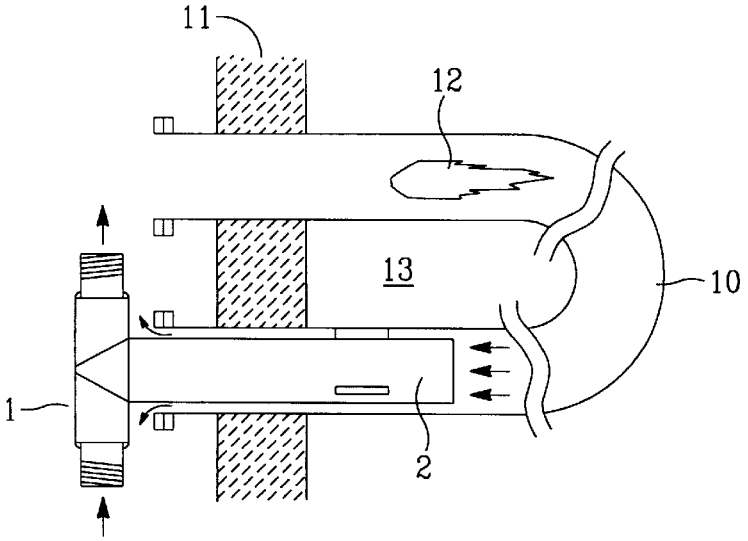
FIG. 2 is a partial cross section view of a burner furnace employing the recuperator of FIG. 1.

FIG. 2 is a partial cross section view of the recuperator of the present invention employed in a combustion furnace 13. A radiant tube 10 extends through an exterior wall of the furnace 11 which is often formed of brick, and extends to an open end adjacent the second tube 5. Combustion flame 12 provides hot exhaust gasses which flow through and exit the radiant tube 10 and impinge second tube 5. The penetrating tube 2 of the recuperator 1 is disposed within the radiant tube 10. Hot exhaust gasses pass over the penetrating tube 2 causing it to heat up. Ambient air is introduced into the second tube 5 and forced through the penetrating tube 2. The ambient air is then heated as is flows along its flowpath. The ambient air is exposed to the heated surface of the penetrating tube 2 along the entire flowpath, substantially twice the length of the penetrating tube 2. Air exiting the recuperator is then channeled to the combustion air introduction duct in a conventional manner.

The present invention is embodied by a simple design which is inexpensive and simple to produce, is made from readily available stock materials, and has been demonstrated to have a service life span exceeding six months without significant wear.

While the foregoing invention has been shown and described with reference to a specific preferred embodiment, it will be understood by those possessing skill in the art that various changes and modifications may be made without departing from the spirit and scope of the invention.

We claim:

1. A combination combustion furnace and recuperator comprising:

a penetrating tube having an open end and a closed end;

a second tube having first and second opposite ends, said second tube attached substantially perpendicular to said open end of said penetrating tube intermediate said first and second ends;

a divider wall disposed within said penetrating and second tubes and being directly adjacent to and extending substantially along a length of said penetrating tube, said divider wall prohibiting direct communication between said first and second ends of said second tube thereby forming an intermediate flowpath through said penetrating tube, wherein said penetrating tube and said second tube form an integral airtight connection between said first and second ends of said second tube; and a plurality of spacer blocks disposed on an outer surface of said penetrating tube, said spacer blocks engaging an internal surface of a radiant tube of said combustion furnace to directly support and position said recuperator within said radiant tube thereby directly exposing said penetrating tube to exhaust gases flowing within said radiant tube.

2. The recuperator according to claim 1, further comprising:

at least one spirally extending member disposed within and substantially extending along said length of said penetrating member, said spirally extending member adapted to enhance heat transfer between said penetrating member and air flowing therewithin.

3. The combination according to claim 2, wherein said spirally extended member is formed of a 14 gage stainless steel having an overall length of about 27 inches.

4. The combination according to claim 1, wherein said second tube is a unitary tube continuously extending between said first and second ends, said unitary tube having a notch between said first and second ends to expose an interior of said second tube, said open end of said penetrating tube having a cut to define a cut end, said cut end, said cut end being disposed over said notch of said second tube and welded to said unitary tube thereby maintaining said airtight connection.

5. The combination according to claim 4 wherein said penetrating tube is formed of a unitary hollow stainless steel tube having an inner diameter of about 1.5 inches, and said second tube is formed of a unitary hollow stainless steel tube having an inner diameter of about 1.5 inches.

6. The combination according to claim 5, wherein said penetrating tube has a length of about 28 inches.

7. The combination according to claim 1, wherein said radiant tube comprises a unitary continuous tube extending from within said furnace to an open end terminating adjacent said second tube.

8. The combination according to claim 1, wherein said second tube continuously extends between said first and second ends, said second tube having a notch between said first and second ends to expose an interior of said second tube, said open end of said penetrating tube having a cut to define a cut end, said cut end being disposed over said notch of said second tube and welded to said second tube.

9. A combination combustion furnace and an air recuperator, said combustion furnace comprising:

a radiant tube attached to an external wall of said combustion furnace, said radiant tube adapted to channel exhaust gases from a burner through said external wall;

said air recuperator comprising:

a hollow penetrating tube substantially disposed within said radiant tube, said penetrating tube has an open end and a closed end, a unitary second hollow tube continuously extending between first and second opposite ends, said open end of said hollow penetrating end being attached to said second hollow tube intermediate said first and second ends and extending orthogonally therefrom, said second hollow tube having a opening to establish air communication between said hollow penetrating tube and said second hollow tube;

a divider wall disposed within said hollow penetrating and said second hollow tubes extending substantially along a length of said hollow penetrating tube, said divider cutting off direct communication between said first and second ends of said second hollow tube thereby establishing an intermediate flow path within said hollow penetrating tube, whereby air entering said first end must flow through said hollow penetrating tube substantially along said length and around said divider wall before emerging from said second end; wherein said hollow penetrating tube, said second hollow tube and said divider form an integral airtight flow channel between said first and second ends of said second hollow tube; and a plurality of spacer blocks secured to an outer surface of said penetrating tube and engaging an inner surface of said radiant tube thereby directly securing and positioning said penetrating tube within said radiant tube;

wherein said radiant tube extends from within said furnace to an open end adjacent said second tube such that said exhaust gases emerging from said open end of said radiant tube impinge on said second tube.

* * * * *